US006247352B1

(12) United States Patent
Green et al.

(10) Patent No.: US 6,247,352 B1
(45) **Date of Patent: *Jun. 19, 2001**

(54) SYSTEM FOR MONITORING DIAPHRAGM PUMP FAILURE

(75) Inventors: Steven R. Green, Eldorado; David L. Powell, Jr., Augusta, both of KS (US)

(73) Assignee: Texaco Inc., White Plains, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/214,021

(22) PCT Filed: Jun. 26, 1997

(86) PCT No.: PCT/US97/11489

§ 371 Date: Sep. 7, 1999

§ 102(e) Date: Sep. 7, 1999

(87) PCT Pub. No.: WO98/00640

PCT Pub. Date: Jan. 8, 1998

Related U.S. Application Data

(63) Continuation of application No. 08/969,644, filed on Jun. 5, 1997, now Pat. No. 5,883,299

(60) Provisional application No. 60/020,838, filed on Jun. 28, 1996.

(51) Int. Cl.[7] ..... G01M 3/04

(52) U.S. Cl. ..... 73/40; 73/40.5 R; 340/605; 417/63; 417/395

(58) Field of Search ..... 73/40, 40.5 R; 250/227.11; 340/604, 605; 356/128, 338; 365/73; 417/46, 53, 383, 63, 395

(56) References Cited

U.S. PATENT DOCUMENTS

| | | | | |
|---|---|---|---|---|
| 3,176,623 | | 4/1965 | Howerton et al. . | |
| 3,647,300 | * | 3/1972 | Skala | 365/73 |
| 4,068,982 | * | 1/1978 | Quarve | 417/387 |
| 4,781,535 | * | 11/1988 | Frawley et al. | 417/53 |
| 4,801,204 | * | 1/1989 | Nakamura et al. | 356/338 |
| 4,844,706 | | 7/1989 | Katsuyama . | |
| 5,005,005 | * | 4/1991 | Brossia et al. | 340/604 |
| 5,062,770 | * | 11/1991 | Story et al. | 417/46 |
| 5,064,530 | * | 11/1991 | Duff et al. | 210/94 |
| 5,145,331 | * | 9/1992 | Goes et al. | 417/383 |
| 5,173,600 | * | 12/1992 | Fillion et al. | 250/227.11 |
| 5,244,360 | * | 9/1993 | Lefebvre | 417/383 |
| 5,343,736 | * | 9/1994 | Cady et al. | 73/40 |
| 5,452,076 | * | 9/1995 | Schopper et al. | 356/128 |
| 5,883,299 | * | 3/1999 | Green . | |

FOREIGN PATENT DOCUMENTS

| | | |
|---|---|---|
| 0419143A1 | 3/1991 | (EP) . |
| 6-93963 | 4/1994 | (JP) . |
| 63-97888 | 4/1998 | (JP) . |
| WO91/02161 | 2/1991 | (WO) . |

* cited by examiner

*Primary Examiner*—Hezron Williams
*Assistant Examiner*—C D Garber
(74) *Attorney, Agent, or Firm*—Morris N. Reinisch; Rodman & Rodman

(57) ABSTRACT

A diaphragm failure monitoring system for detecting leakage in a diaphragm of a diaphragm pump. The system includes a pump having an operating chamber containing a working fluid and a pumping chamber for pumping material into and out of the pump and a diaphragm separating the operating and pumping chambers. A first optic fiber is joined to the operating chamber for transmitting an optic signal across the working fluid. A second optic fiber is joined to the operating chamber for receiving the optic signal from the first optic fiber. An electric signal establishing device establishes a first electrical signal when the optic signal from the first optic fiber to the second optic fiber passes through uncontaminated working fluid. The electric signal establishing device establishes a second electrical signal when the optic signal from the first optic fiber to the second optic fiber passes through contaminated working fluid, whereby leakage of a contaminating material through the diaphragm into the operating chamber can be detected when the second electrical signal is established.

12 Claims, 2 Drawing Sheets

SYSTEM FOR MONITORING DIAPHRAGM PUMP FAILURE

This application claims the benefit of U.S. Provisional Application No. 60/020,838 filed on Jun. 28, 1996 and is a continuation of Ser. No. 08/969,644, filed Jun. 5, 1997 and now U.S. Pat. No. 5,883,299.

BACKGROUND OF THE INVENTION

This invention relates to a diaphragm pump for pumping slurry, and more particularly to a monitoring system for determining when the diaphragm of the pump has begun to fail.

Slurry pumps are often used with gasifiers to pump slurries of coal, coke and/or carbon into the gasifier for conversion to carbon monoxide and hydrogen. A well known slurry pump includes a flexible diaphragm that is usually formed of rubber or some other, durable, flexible material. The diaphragm is deflected or pulsed by oil that is pressurized and depressurized in accordance with movement of a piston or plunger in the pump. Generally, a glycol-based oil is used as a working fluid for actuation of the diaphragm. The diaphragm shields the oil and the pump mechanism from a pump chamber or transfer chamber wherein slurry passes into and out of the pump.

Thus, when a slurry pump operates properly, the slurry is drawn into the pump chamber and pumped out of the pump chamber without encountering the actuating mechanism or working fluid of the pump. The pump diaphragm, due to the abrasive nature of the slurry as it moves in and out of the pump chamber, is subject to wear. Ultimately, the wearing action of the slurry on the diaphragm will cause the diaphragm to rupture, resulting in pump failure because of commingling of the slurry with the pump mechanism and the working fluid of the pump. Although gradual deterioration of the pump diaphragm is expected due to the wear imposed by the slurry movement, sudden rupture of the diaphragm can occur at unpredictable times.

A typical slurry pump often includes a visual port that is usually monitored periodically by an attendant to detect visible contamination of the oil in the pump which can indicate impending rupture of the pump diaphragm. However, visual monitoring is not a reliable means of detecting impending rupture of the pump diaphragm because slight leaks in a diaphragm at the earliest stages of diaphragm failure are generally not visually perceptible.

Once a slurry pump is rendered inoperable due to diaphragm rupture, the gasifier operation must be shut down while the slurry pump is either repaired or replaced. Any shutdown of a gasifier operation is burdensome and expensive since gasifier shutdown and start-up operations, as well as pump repair and replacement operations, are time consuming and expensive, and require immediate availability of skilled personnel.

Although rough forecasts can be made, based on statistical data, of when a diaphragm will rupture, there are no presently known means for precisely predicting the earliest stages of diaphragm breakdown before severe damage occurs to the pump mechanism. Consequently, skilled personnel are often required to monitor and maintain pump operations.

It is therefore desirable to provide a reliable method and means for detecting the earliest stages of diaphragm failure in a slurry pump so that the pump can be shut down for repairs before the diaphragm failure causes severe damage to the pump mechanism.

OBJECTS AND SUMMARY OF THE INVENTION

One of several objects of the invention is the provision of a novel method and means of accurately detecting any deterioration in a diaphragm of a diaphragm pump that results in a slight leakage of the diaphragm. Another object of the invention is the provision of a novel method and means for detecting an impending rupture of a diaphragm in a diaphragm pump before the rupture causes damage to the pumping mechanism. Another object of the invention is the provision of a novel method and means of detecting impending rupture of a diaphragm in a diaphragm pump without the need for personnel to monitor the diaphragm pump. Another object of the invention is the provision of a novel method and means which employs optic signals for detecting deterioration or impending rupture of a diaphragm in a diaphragm pump.

In accordance with the present invention, a diaphragm failure monitoring system is provided for automatically detecting leakage in a diaphragm of a diaphragm pump. The diaphragm pump includes a pumping chamber with a slurry inlet port and a slurry outlet port. The diaphragm pump also includes an operating chamber containing a working fluid. The diaphragm separates the pumping chamber from the operating chamber and isolates the slurry from the working fluid. A reciprocating piston pulsates the working fluid against the diaphragm to deflect the diaphragm and thereby pump the slurry into and out of the pumping chamber.

The monitoring system cooperates with the operating chamber which contains the working fluid of the diaphragm pump. The monitoring system includes a first optic fiber located at the operating chamber for transmitting an optic signal across the working fluid to an oppositely disposed, second optic fiber. The monitoring system generates a first electrical signal when the optic signal passes through uncontaminated working fluid, and an electrical signal different from the first electrical signal when the optic signal passes through contaminated working fluid. Thus, contamination of the working fluid as a first sign of diaphragm failure can be detected when a signal other than the first electrical signal is detected by the monitoring system.

In one embodiment of the invention, the monitoring system includes a hollow, optical cell secured to the pump at the operating chamber to receive a portion of the working fluid. The first and second optic fibers are connected to the optical cell to transmit and receive optical signals across the working fluid in the optical cell.

The invention also provides a method of detecting leakage in a diaphragm of a diaphragm pump in which the pump has an operating chamber for receiving a working fluid. The method includes transmitting an optic signal across the working fluid to a signal receiver for conversion to an electrical signal. The method further includes establishing a first electrical signal to function as a base measure when the received optic signal passes through uncontaminated working fluid, and establishing a second electrical signal different from the first electrical signal when the received optic signal passes through contaminated working fluid. In accordance with the foregoing method when the second electrical signal is established contamination of the working fluid due to diaphragm failure can be detected.

The invention therefore solves the problem of detecting slight deterioration leakage and impending rupture of a pump diaphragm. The invention achieves the foregoing objects by using an optical monitoring system which relies upon changes in the absorption of light by the working fluid in the pump due to fluid contamination to indicate deterioration or impending failure of the diaphragm before the diaphragm failure causes severe damage to the pump mechanism.

DESCRIPTION OF THE DRAWINGS

In the drawings.

Corresponding reference characters indicate corresponding parts throughout the several views of the drawings.

DETAILED DESCRIPTION

Figure 1:
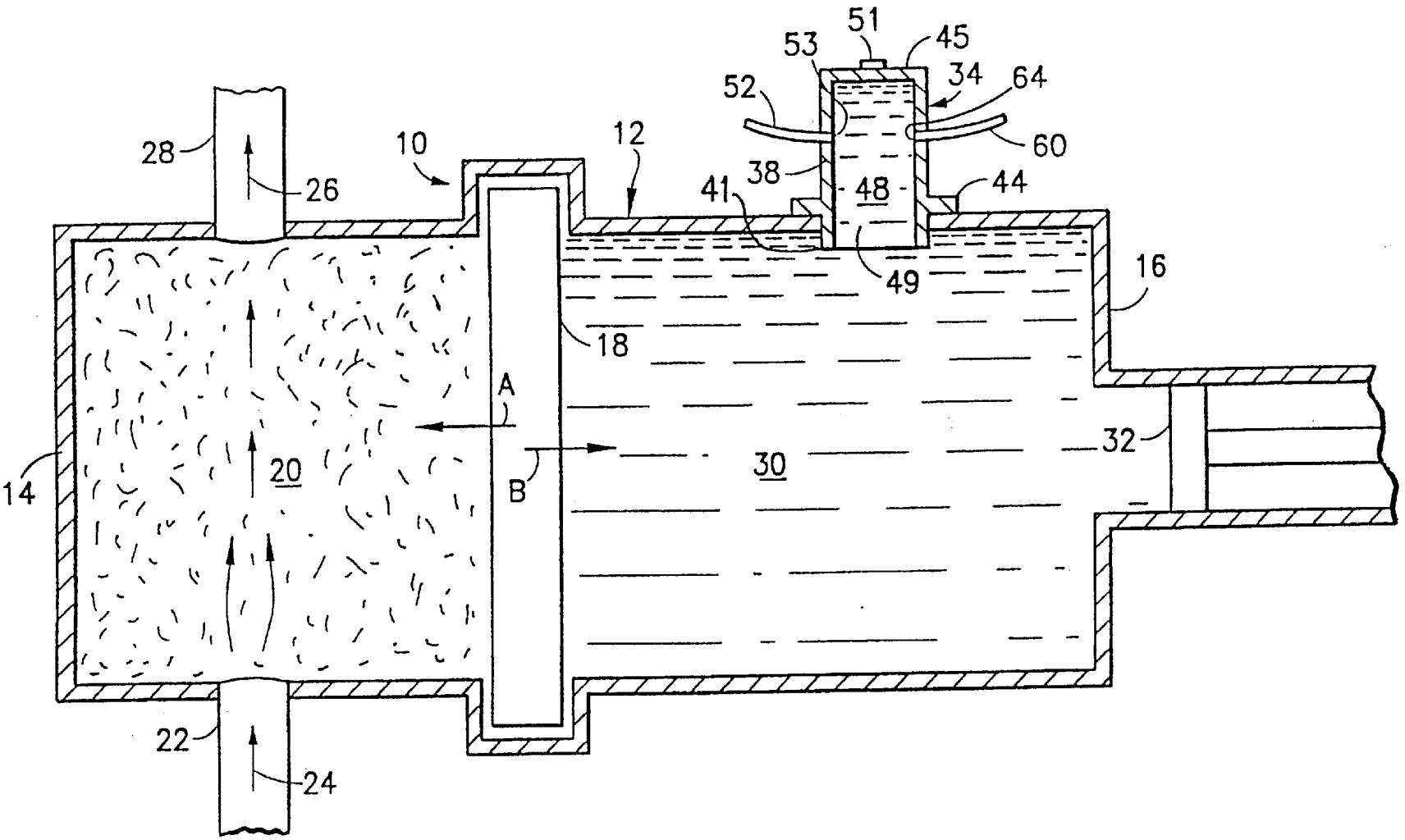
FIG. 1 is a simplified schematic sectional view of a system for monitoring diaphragm failure of a slurry pump, incorporating one embodiment of the invention.

Referring to FIG. 1 of the drawings, a slurry pump is generally indicated by the reference number 10.

The slurry pump 10 includes a housing 12 with a pumping chamber 14 and an operating chamber 16 and a flexible diaphragm 18 that separates the pumping chamber 14 from the operating chamber 16. The pumping chamber 14 receives an incoming flow 24 of a slurry 20 through a pump inlet 22 and provides an outgoing flow 26 of the slurry 20 through a pump outlet 28 into a known partial oxidation reactor (not shown) such as the type disclosed in U.S. Pat. No. 5,545,238. The slurry 20 can be a slurry of coal, coke, and/or carbon. The operating chamber 16 has a confined, fixed amount of a working fluid 30, such as any suitable, known oil.

A piston 32 reciprocates back and forth to pulsate the working fluid 30 in the operating chamber 16 against the flexible diaphragm 18 which is preferably formed of a suitable known flexible, durable material such as rubber.

An optical cell 34 is joined to the pump 10 at the operating chamber 16 and includes a hollow, cylindrical cell housing 38. The cell housing 38 includes a securement end 40 with a neck 41 having an O-ring 42 and a clamping flange 44. The neck 41 with the O-ring 42 fits into an opening 46 (FIG. 2) in the pump housing 12 at the operating chamber 16 in leak-tight fashion. The clamping flange 44 is fastened to the housing 12 in any suitable manner, such as with bolts (not shown) that extend through bolt openings 47 (FIG. 3) in the flange 44. Under this arrangement, a portion of the working fluid 30 in the operating chamber 16 can distribute into the hollow portion 48 of the optical cell 34 through the opening 49 of the neck 41. An opposite end 50 of the cell housing 38 includes a suitable, known sight plug 51.

Figure 2:
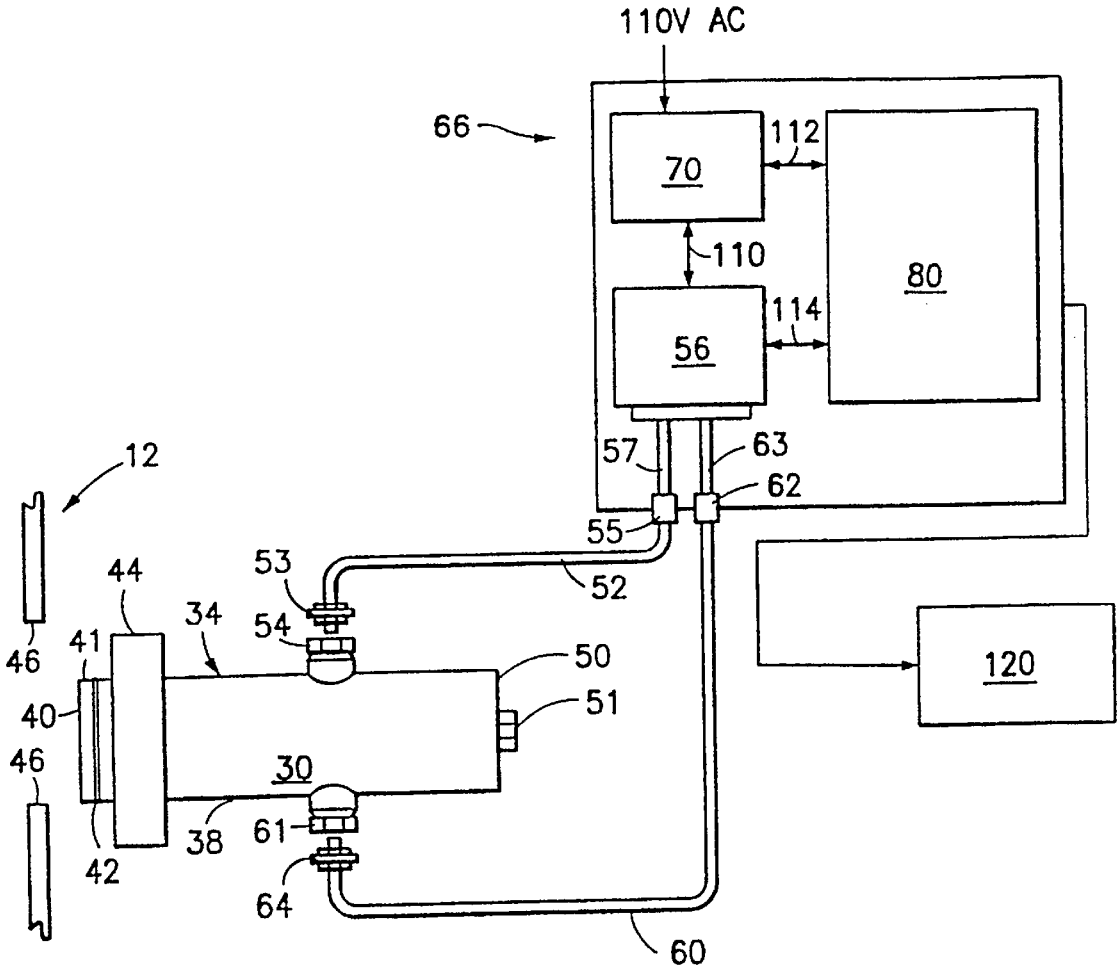
FIG. 2 is an enlarged view of an optical cell thereof and its associated electronic components; and, FIG. 3 is a perspective view of the optical cell thereof.
Figure 3:
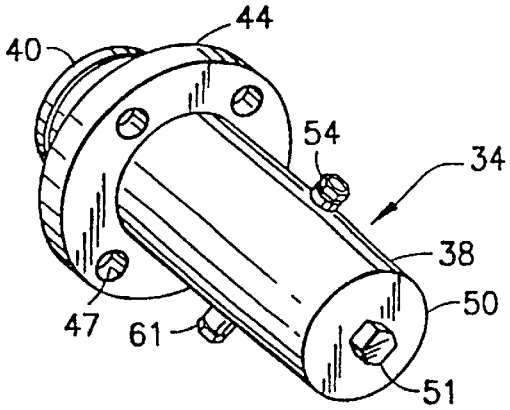

Referring to FIGS. 1 and 2, a first fiber optic cable 52 of suitable, known construction has one end referred to as an emitter end 53 connected in leak-tight fashion to one side of the cell housing 38 by a known connection plug 54. The emitter end 53 thus communicates with the hollow space 48 in the cell housing 38. An opposite end 55 of the fiber optic cable 52 is connected to an optical amplifier 56 at a first junction 57. The optical amplifier 56 is of the type made by Tri-Tronics Co. Inc. of Tampa, Fla. under the product designation Model No. SALG.

A second fiber optic cable 60 similar to the first fiber optic cable 52 has one end referred to as a collector end 64 connected in leak-tight fashion to an opposite side of the cell housing 38 by a connection plug 61. An opposite end 62 of the fiber optic cable 60 is connected to the optical amplifier 56 at a second junction 63. An approximate distance between the emitter end 53 and the collector end 64 is 3 to 5 inches.

The optical amplifier 56 is a constituent of a detection circuit 66 that includes a known power supply 70 of the type sold by Astec Corporation under the designation ACB24N1.2, and an isolation signal conditioner 80 of the type sold by Action Instruments under the designation Transpak Model 2703-2000.

The optical amplifier 56, the power supply 70, and the isolation signal conditioner 80 communicate with each other via the lines 110, 112, 114. The detection circuit 66 communicates in a known manner with a known distributive control system 120 of the type sold by Honeywell Inc. under the product designation ATM.

During operation of the pump 10, the piston 32 reciprocates back and forth at a predetermined rate. The reciprocating action of the piston 32 on the working fluid 30 forces the diaphragm 18 to deflect back and forth against the slurry 20 in the pumping chamber 14 as indicated by the arrows A and B in FIG. 1. Deflection of the diaphragm 18 pumps the slurry 20 through the pumping chamber 14 into a gasifier (not shown) in a conventional manner. During the pumping operation, an optic signal in the form of light is generated through the first fiber optic cable 52 by the optical amplifier 56. The optic signal is emitted at the emitter end 53 and passes through the working fluid 30 in the optical cell 34 to the collector end 64 of the second fiber optic cable 60.

The light signal is preferably a high intensity, green light which is produced by the optical amplifier 56 and passes from the first fiber optic cable 52 through the second fiber optic cable 60 back to the optical amplifier 56. The optical amplifier 56 converts the light energy to a voltage, such as, for example, a one to ten volt signal. The voltage signal can be adjusted on an analog output by the gain and/or offset of the optical amplifier 56. The voltage signal can vary in accordance with the intensity of the light. For example, a one volt signal can represent a dark intensity of light and a ten volt signal can represent a light intensity of light. The amplifier 56 can be set in a known manner to any analogous value to represent a normal light transmission, such as nine volts.

If the working fluid 30 within the operating chamber 16 becomes contaminated by some portion of the slurry 20 leaking through pin holes or through any relatively small opening in the diaphragm 18, the working fluid 30 will undergo a change in color resulting in a general darkening of the fluid 30. When the fluid 30 darkens, the intensity of the light signal passing from the emitter end 53 to the collector end 64 decreases. The voltage signal from the amplifier 56 in response to the light signal will then decrease to indicate a darkening of the working fluid 30 as a result of entry of the slurry 20 into the operating chamber 16 due to slight leakage at the early deterioration or early rupture stages of the diaphragm 18. The electrical information that is analogous to the condition of the working fluid 30 in the optical cell 34 is converted to a desirable, measurable parameter, such as milli-amperes, and fed to the distributive control system 120 through the isolation signal conditioner 80.

Thus, when the diaphragm 18 does not leak, the working fluid 30 will be clear and the light signal received by the second optic cable 60 will be relatively strong based on the known clarity of uncontaminated working fluid 30 and because of minimal absorption of the light signal by the clear working fluid 30. A corresponding voltage signal will be generated by the optical amplifier 56 to represent the uncontaminated working fluid 30.

When the diaphragm 18 begins to fail due to the development of a leakage condition in the diaphragm 18 because of pin holes, cracks or any other manifestation of early breakdown of the diaphragm 18, the working fluid 30 will be less clear or contaminated because a portion of the slurry 20 will have leaked through the diaphragm 18 into the working fluid 30. In such a case, a weaker light signal will be received by the second fiber optic cable 60 from the first fiber optic cable 52 for transmission to the optical amplifier 56. The light signal is weaker because the darker, contaminated working fluid 30 will absorb more of the light signal transmitted by the first optic cable 52. A correspondingly weaker voltage signal will be generated by the optical amplifier 56 to represent contaminated working fluid 30.

From the foregoing description, it can be seen that low levels of contamination of the working fluid 30 can be detected to indicate the earliest stages of deterioration that result in diaphragm leakage which leakage signals an impending rupture of the diaphragm 18. Once the contamination of the working fluid 30 is detected before severe pump damage occurs, remedial measures can be taken which do not require a complete shutdown of the pump 10 and the associated gasifier. Moreover, the slurry pump 10 can be repaired by simply replacing the diaphragm 18 without the need to overhaul the working mechanism of the pump 10. Thus, early detection of a leak in the diaphragm 18 in accordance with the instant invention results in substantial cost savings and minimal interruption to a gasifier operating system.

Although the present invention has been described in terms of a single, preferred embodiment, it is anticipated that various modifications and alterations thereof will be apparent to those skilled in the art.

What is claimed is:

1. A diaphragm failure monitoring system and apparatus for detecting leakage in a diaphragm of a diaphragm pump comprising, a) a pump having an operating chamber containing a light transmissive working liquid and a pumping chamber for pumping material into and out of the pump and a diaphragm separating the operating chamber and the pumping chamber;

b) a first optic fiber joined to said operating chamber at a first location for transmitting an optic signal across said working liquid;

c) a second optic fiber joined to said operating chamber at a second location in spaced arrangement from said first optic fiber, and without being connected to said first optic fiber at said operating chamber, for receiving said optic signal that is transmitted though said working liquid from said first optic fiber;

d) an electrical signal provider connected to said second optic fiber for providing a first electrical signal, corresponding to a minimum optic signal level of light attenuation, when the optic signal from said first optic fiber to said second optic fiber passes through the working liquid in an uncontaminated state;

e) said electrical signal provider providing a second electrical signal different from the first electrical signal, and corresponding to a higher optic signal level of light attenuation than the minimum optic signal level of light attenuation, when the optic signal from said first optic fiber to said second optic fiber passes through working liquid in a contaminated state, whereby leakage of a contaminating material, that is part of the material being pumped, into said working liquid through said diaphragm into said operating chamber can be detected when said second electrical signal is established;

f) a hollow, optical cell secured to said operating chamber for receiving a portion of the working liquid, and wherein the first location of said first optic fiber and the second location of said second optic fiber are at opposite sides of said optical cell;

g) said first optic fiber including an emitter end for transmitting said optic signal across said working liquid and said second optic fiber including a collector end for receiving said transmitted optic signal, and wherein the electrical signal provider comprises an optical amplifier; and, h) an isolation signal conditioner connected to said optical amplifier, and a distributive control system connected to said isolation signal conditioner, wherein said first and second electrical signals are fed from said optical amplifier to said distributive control system through said isolation signal conditioner.

2. The apparatus of claim 1, wherein said diaphragm comprises rubber.

3. The apparatus of claim 1, further comprising a power supply communicating with said optical amplifier and said isolation signal conditioner.

4. The apparatus of claim 1, wherein said optic signal comprises a high intensity green light.

5. A diaphragm pump comprising, a) an operating chamber containing a working fluid, a pumping chamber for pumping material into and out of the pump and a diaphragm separating the operating chamber and the pumping chamber, b) an optical cell including a hollow cell housing having opposite ends and a wall surrounding said opposite ends such that said cell housing defines a hollow space, one of said opposite ends being a securement end for securement to the diaphragm pump at the operating chamber, said securement end having an opening to said hollow space, said securement end including means for securing said cell housing to one side of said operating chamber such that the opening to the hollow space of said cell housing is communicable with the operating chamber of said diaphragm pump to enable the cell housing to receive working fluid from the operating chamber of the diaphragm pump while the diaphragm pump is in operation, the opposite end of said cell housing being remote from said diaphragm pump, c) a first optic fiber joined to said cell housing for transmitting an optic signal through the hollow space of said cell housing, d) a second optic fiber joined to said cell housing in spaced arrangement from said first optic fiber, and without being connected to said first optic fiber at said cell housing, for receiving said optic signal from said first optic fiber, e) means for establishing a first electrical signal corresponding to a minimum optic signal level of light attenuation, when the optic signal from said first optic fiber to said second optic fiber passes through the working fluid in the hollow space of said cell housing in an uncontaminated state, f) means for establishing a second electrical signal, different from the first electrical signal, and corresponding to a higher optic signal level of light attenuation than the minimum optic signal level of light attenuation, when the optic signal from said first optic fiber to said second optic fiber passes through working fluid in the hollow space of said cell housing in a contaminated state whereby leakage of a contaminated material, that is part of the material being pumped, into said working fluid through the diaphragm of said diaphragm pump into said operating chamber can flow into the hollow space of said optical cell through the opening in said one end of the cell housing, and said leakage of contaminating material can be detected in said cell housing when said second electrical signal is established, g) and wherein said cell housing includes first means for connecting with said first optic fiber and second means for connecting with said second optic fiber, h) and wherein said first and second connecting means are located at opposite sides of said optical cell and wherein said first optic fiber includes an emitter end connected to said first connecting means and a first optic fiber opposite end, and said second optic fiber includes a collector end connected to said second connecting means and a second optic fiber opposite end, and wherein said means for establishing said first electrical signal and said means for establishing said second electrical signal comprise an optical amplifier connected to the opposite ends of the first and second optic fibers, i) and wherein said optic signal comprises a high intensity green light, and j) an isolation signal conditioner connected to said optical amplifier, and a distributive control system connected to said isolation signal conditioner, wherein said electrical signals are fed from said amplifier to said distributive control system through said isolation signal conditioner.

6. The diaphragm pump of claim 5 wherein said cell housing is cylindrical.

7. The diaphragm pump of claim 5, additionally comprising a power supply communicating with said optical amplifier and said isolation signal conditioner.

8. The diaphragm pump of claim 5 including a sight member provided at the opposite end of said cell housing to permit outside viewing of the interior hollow space of said optical cell.

9. The system and apparatus of claim 1, wherein said cell housing has opposite ends, one of said opposite ends being a securement end for securement to the diaphragm pump at the operating chamber, said securement end having an opening to said operating chamber to enable the cell housing to receive working fluid from the operating chamber while the diaphragm pump is in operation.

10. The system and apparatus of claim 1, wherein said cell housing is cylindrical.

11. The system and apparatus of claim 1, wherein said cell housing includes first means for connecting with said first optic fiber and second means for connecting with said second optic fiber, said first and second connecting means being located at said opposite sides of said optical cell.

12. The system and apparatus of claim 9 including a sight member provided at the opposite end of said cell housing to permit outside viewing of the interior hollow space of said optical cell.

* * * * *

UNITED STATES PATENT AND TRADEMARK OFFICE

CERTIFICATE OF CORRECTION

PATENT NO. : 6,247,352 B1
DATED : June 19, 2001
INVENTOR(S) : Steven R. Green and David L. Powell, Jr.

It is certified that error appears in the above-identified patent and that said Letters Patent is hereby corrected as shown below:

Title page,
Item [63], change "08/969,644" to -- 08/869,644 --.

Column 1,
Line 5, change "08/969,644" to -- 08/869,644 --.

Signed and Sealed this

Twenty-third Day of April, 2002

*Attest:*

*Attesting Officer*

JAMES E. ROGAN
*Director of the United States Patent and Trademark Office*